United States Patent [19]

Patterson

[11] Patent Number: 4,620,374

[45] Date of Patent: Nov. 4, 1986

[54] HAIRSTYLIST GLOVE

[76] Inventor: Dennis E. Patterson, Rte. 2, Box 232, Catoosa, Okla. 74015

[21] Appl. No.: 777,077

[22] Filed: Sep. 17, 1985

[51] Int. Cl.[4] ..... A45D 20/04

[52] U.S. Cl. ..... 34/97; 34/99; 132/9; 219/373

[58] Field of Search ..... 34/98, 97, 96, 99, 103, 34/104; 132/9; 219/373; 126/204

[56] References Cited

U.S. PATENT DOCUMENTS 2,427,673 9/1947 Holthouse ..... 126/204

3,613,257 10/1971 Yashiike et al. ..... 34/97

4,138,827 2/1979 Baugh et al. ..... 34/98

4,209,913 7/1980 Wallin et al. ..... 34/21

*Primary Examiner*—Larry I. Schwartz

*Attorney, Agent, or Firm*—Head, Johnson & Stevenson

[57] ABSTRACT

A hair working glove comprising an inner glove shell and an outer glove shell each made of material essentially non-permeable to air with the outer glove shell surrounding said inner glove shell and forming a space therebetween. A warm air supply is provided to supply air to the space between the outer and inner glove shells and out holes in the palm side of the fingers of the outer glove shell. There is also comb segments attachable to the palm side of the fingers of the outer glove shell.

9 Claims, 5 Drawing Figures

HAIRSTYLIST GLOVE

BACKGROUND OF THE INVENTION

This invention relates to a portable hair drying apparatus and more particularly a hair drying apparatus to be worn on the hand. Most present day hairstylist employ a warm air blower to blow hair to dry it while at the same time using a comb to comb the hair to get the desired effect. The present practice normally requires both hands, athough there have been suggestions for ways of using only one hand. Attention is directed to U.S. Pat. No. 4,138,827 which concerns a wrist monted hair drying apparatus for blowing heated air to the palm of the hand wherein it could be directed to the hair of the user in concentrated form. The apparatus includes a motor driven blower mounted by a strap on the wrist of the user. The outlet of the blower includes a flexible hose terminating in an oval shaped ring mounted over the fingers of the user and having a plurality of air openings along one surface thereof adjacent to the palm for concentrating the air from the blower in the palm of the hand of the user.

SUMMARY OF THE INVENTION

This is a hairstylist working glove comprising an inner glove shell and an outer glove shell with a space therebetween with the outer glove shell having holes therein on the palm side. The outer and inner glove shells are sealed near the wrist area. A warm air supply means supplies air to the space between the inner and outer glove shell so that warm air may be forced out the holes in the palm side of the glove. In a preferred embodiment, the glove shells are provided with four fingers and a thumb portion with a comb attachable to the palm side of the finger sections so that the hair can be combed as it is being blown dry by the warm air. In an especially preferred embodiment, the palms of the fingers of the outer shell are provided with connecting means such as ridges so that comb segments can be removably secured thereto.

In the preferred embodiment, the warm air supply is provided by a hair blower connected to an inlet on the back side of the outer glove shell.

It is an object of this invention to provide a hairstylist glove so that warm air can be conveniently blown onto the hair while the hairstylist is manipulating the hair. It is another object that while blowing warm air on the hair, that the hairstylist can use comb segments on the fingers of the glove to further manipulate the hair.

DETAILED DESCRIPTION OF THE PREFERRED EMBODIMENT

Figure 1:
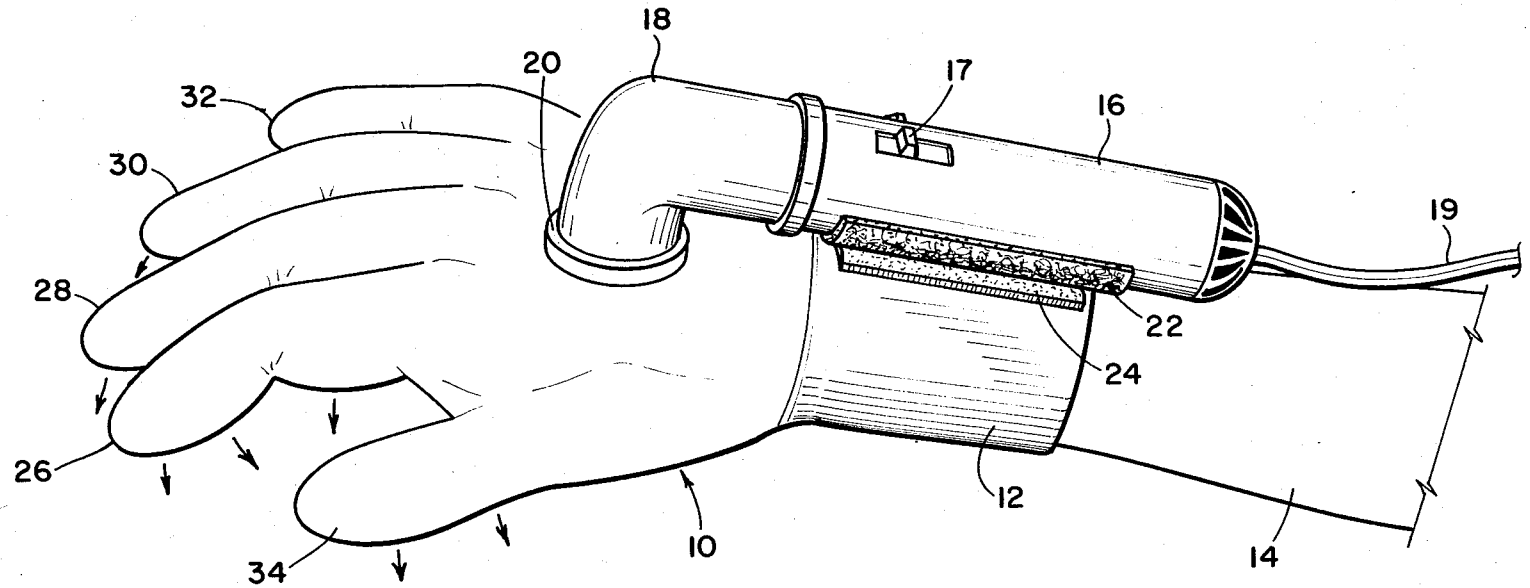
FIG. 1 illustrates the top view of a glove embodying my invention.

Attention is next directed to FIG. 1. Shown thereon is a two-layer or two-shelled glove 10 having a wristlet 12 which is supported on a human arm 14. This glove has fingers 26, 28, 30 and 32 and thumb 34. A warm air hairblower 16 having switch 17 is attachable to the glove by velcro 22 which is attached to the blower 16 and velcro material 24 which is on the wristlet 12. The hairblower has an outlet ell 18 which is connected to an inlet 20 on the back of glove 10 which leads to the space between the two shells of the glove. The connection between ell 18 and inlet 20 on the glove can be any snap-on, screw or other type connector which connects the two together in a sealing relationship. The blower 16 is of a type readily available which produces the proper amount or volume of air at any selected temperatures used by hairstylists. The hairblower 16 can be either self-contained with batteries or preferably it will be connected by a cord 19 to a regular A/C outlet.

Figures 2, 3:
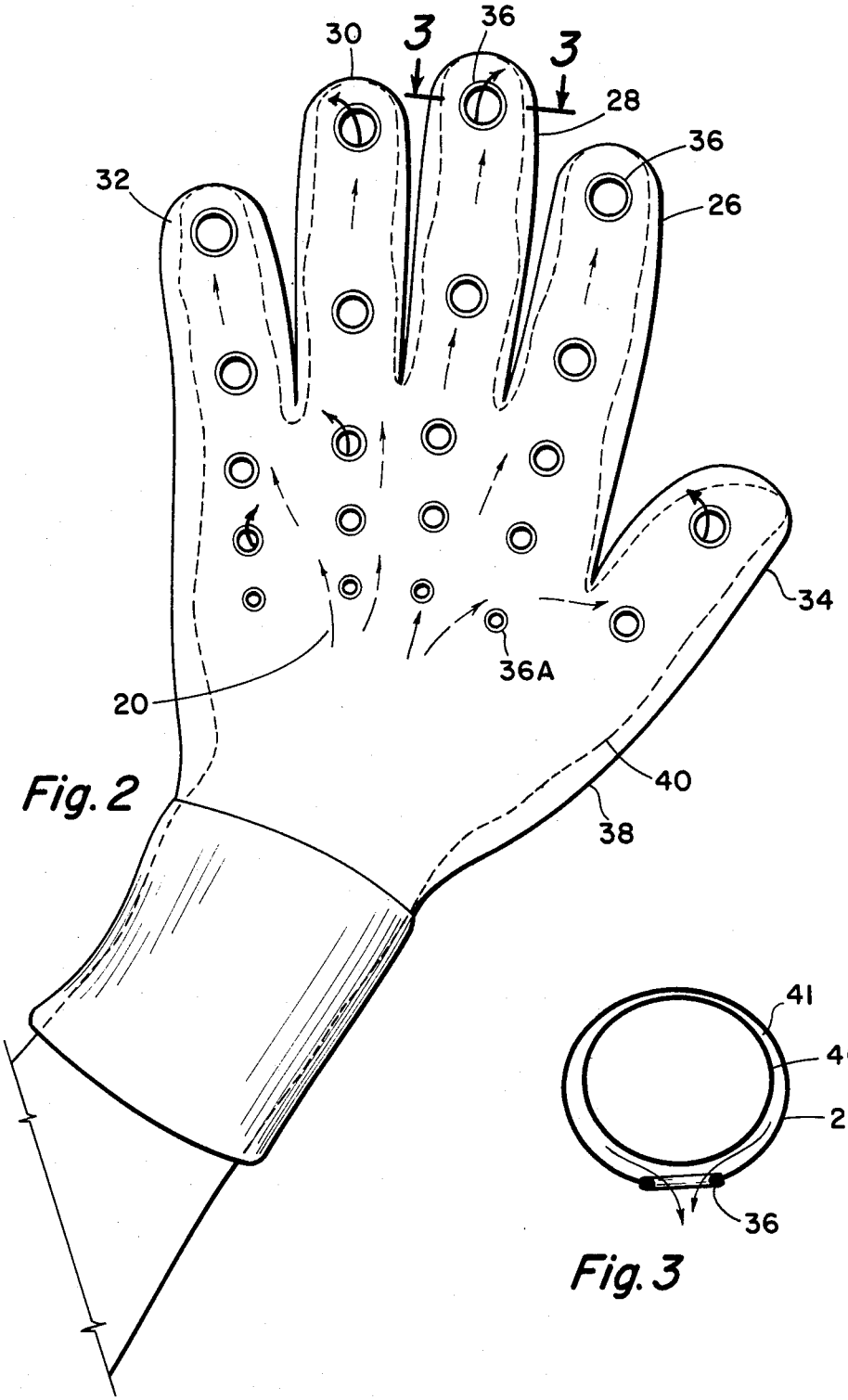
FIG. 2 shows the palm side of the glove of FIG. 1 with warm air oulets in the palm and finger portion.
FIG. 3 is a view taken along the line 3—3 of FIG. 2.

Attention is next directed to FIGS 2 and 3. FIG. 2 is a view with the palm facing the viewer. It has a plurality of eyelets 36 in the palm, fingers and thumb of the underside of the glove. As shown in FIG. 3, the glove is made of an outer layer or shell 38 and an inner layer or shell 40. In other words, there is one glove inside the other. Each glove is made of an air impermable flexible material. As shown in FIG. 3, the eyelet 36 are only in the outer shell 38. The warm air output from hairdryer 16 is connected through ell 18 to the space 41 between the outer shell or outer glove 38 and the inner shell or inner glove 40. The air thus travels through space 41 to the various outlets 36 in the fingers, thumb and palm of the outer shell 38. Although I have shown outlets 36 in the palm and fingers in FIG. 2, I may in some cases, prefer to have the outlets only in the finger portions. If I have outlets 36 as shown in FIG. 2, I prefer that the outlets 36A near the inlet 20 of the warm air be smaller than the outlets 36 at the tip of the fingers. In fact I preferably progressively make the outlets 36 increasingly larger from 36A out to the tips of the fingers. This helps insure a more uniform distribution of the air. Air flows out as indicated by the arrows in the various drawings. A suitable material for the inner shell 40 and the outer shell 38 is material sold under the tradename Panotex/Prosteel. One would like for the material of the inner shell 40 to be such as to give some insulation to the hand of the wearer but still be flexible and impermable to air.

Figure 4:
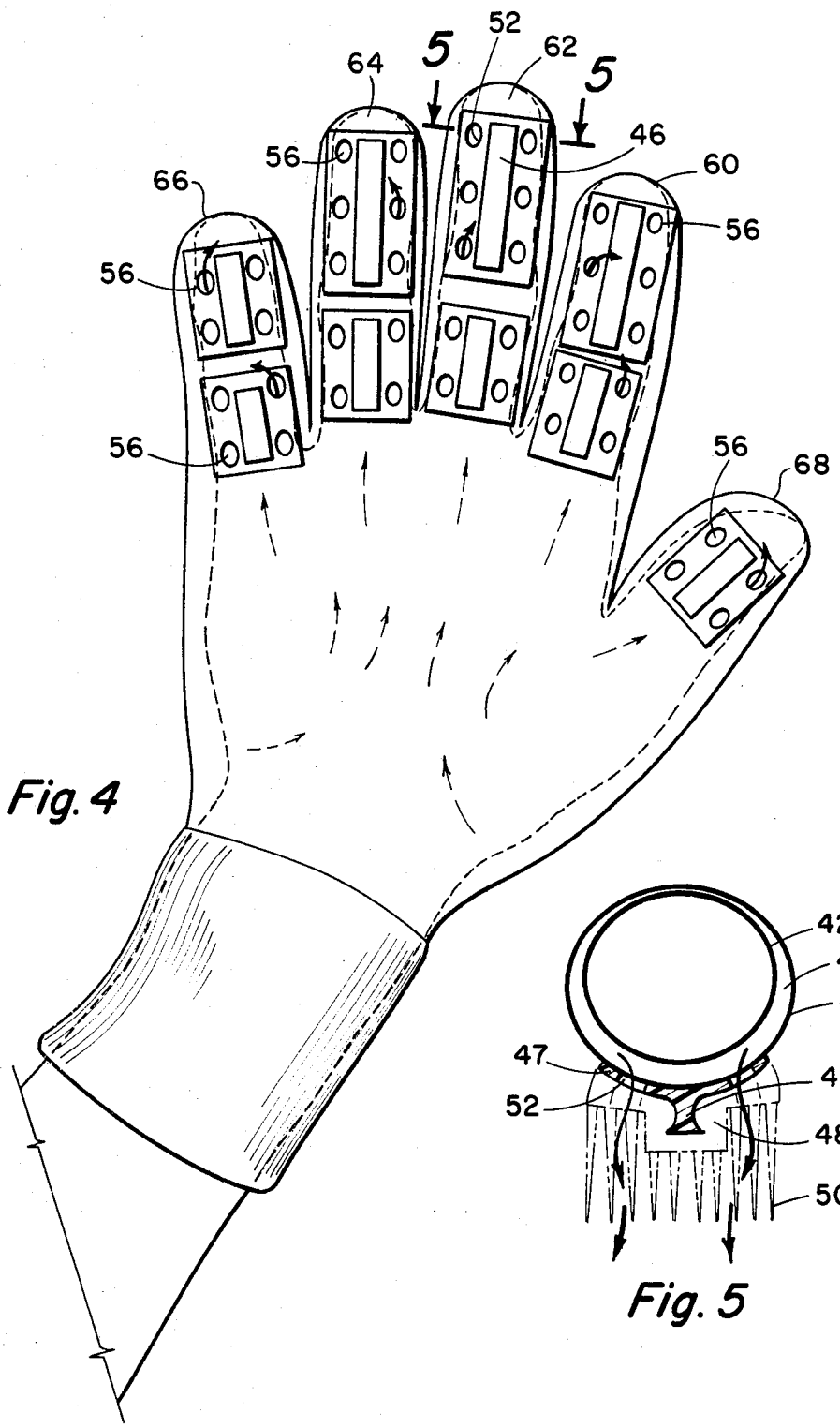
FIG. 4 is a modification of the embodiment of FIG. 2 showing means to which a comb can be attached to the thumb and fingers.
Figure 5:
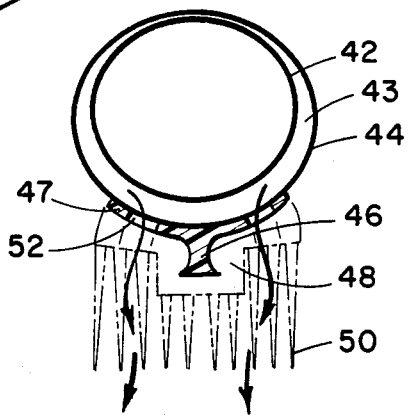
FIG. 5 is a view along the line 5—5 of FIG. 4 and shows in dotted line a comb attached thereto.

In operation or use of the glove shown in FIG. 2, the hairstylist can manipulate the hair while warm air is being blows directly on the portion being manipulated or styled. However, sometimes it is desired that a comb be used to assist in this styling at the same time the warm air is being blown thereon. In order to accomplish this, I have also invented the embodiment shown in FIGS. 4 and 5. Shown thereon, as indicated in FIG. 5, the glove is quite similar to that described above in regard to FIGS. 1 and 2 in that it has an inner layer 42 and an outer layer 44 which are the same as inner layer 40 and outer layer 38 described above. Warm air flows through space 43 between the two shells of the glove and out outlets 56 in the fingers and thumb of the glove of FIG. 4. There are shown ten such outlets 36 on fingers 60, 62 and 64; eight outlets 56 on finger 66 and four outlets on thumb 68. Other numbers of outlets can be used to obtain the desired distribution of the warm air. The embodiments shown in FIGS. 4 and 5 provide for combs to be carried by the fingers and thumb so that the hairstylist can comb the hair while the hair is being blown dry. As shown in FIG. 5, there is a comb receiving ridge 46 mounted on the outer layer or shell 44 of the glove. This can be a hard rubber-like material which is glued or otherwise secured to the glove shell 44. Air outlets 52 are provided in the base 47 of the ridge 46. As shown in FIG. 5 in dotted line, a comb having a comb base 48 is provided with a groove for receiving ridge 46. This comb base 48 has comb teeth 50.

The comb securing ridges are provided in two or more sections on fingers so that flexibility of the fingers will not be impaired. When utilizing the embodiment of FIGS. 4 and 5, combs 50 are placed on the desired ridges 46 on the thumbs and fingers as may be desired and warm air is then blown through the outlet ports 56 and ports 52 from hairblower 16. The hairstylist can then blow warm air on the hair at the same time that the combing of the hair occurs. This is very advantageous inasmuch as the warm air in the comb is exactly where it is needed. It is also convenient and only one hand needs to be used to manipulate this.

While this invention has been described with a certain degree of particularity, it is manifest than many changes may be made in the details of construction in the arrangement of components without departing from the spirit and scope of the disclosure. It is understood that the invention is not limited to the embodiment set forth herein for purposes of exemplification, but is limited only by the scope of the attached claim or claims, including the full range of equivalency to which each element thereof is entitled.

What is claimed:

1. A hair working glove comprising:

an inner glove shell made of an essentially air impermeable flexible material;

an outer glove shell made of an essentially air impermeable flexible material placed over said inner glove shell forming a space therebetween, there being holes on the palm side of said outer glove shell;

warm air supply means for supplying air to said space between said inner and outer glove shells so that the warm air may be forced out said holes.

2. A hair working glove as defined in claim 1 including comb sections attached to the palm side of said outer glove shell.

3. A hair working glove as defined in claim 1 in which said inner glove shell and said outer glove shell includes four finger sections and one thumb section, and comb sections attached to the palm side of at least two fingers of said outer glove shell.

4. A hair working glove as defined in claim 3 in which there are holes in both the palm portion and the finger sections on the palm side.

5. A hair working glove as defined in claim 1 including comb sections with securing means and complimentary securing means on said palm side of said fingers to receive and secure said comb segments.

6. A hair working glove as defined in claim 1 in which said warm air supply means includes an outlet tube and an opening in the outer shell on the backside for sealingly receiving said tube from said warm air supply means.

7. A warm air hair working glove which comprises:

an outer glove shell having fingers with holes in the palm side of such fingers;

an inner glove shell having fingers with an air space formed between the inner and outer glove shell;

a warm air inlet on the back of said outer glove shell;

passage means constituted by said air space and connecting said warm air inlet to said holes in said fingers.

8. A warm air hair working glove as defined in claim 7 including comb segments attached to the palm side of at least one of said fingers.

9. A warm air hair working glove as defined in claim 7 and including ridges on said palm side of said fingers and comb segments with slots to receive said ridges.

* * * * *